US008052550B2

(12) United States Patent
Morrow et al.

(10) Patent No.: US 8,052,550 B2
(45) **Date of Patent: *Nov. 8, 2011**

(54) LACROSSE HEAD

(75) Inventors: David K. Morrow, Metamora, MI (US); Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/106,895

(22) Filed: May 13, 2011

(65) Prior Publication Data

US 2011/0218061 A1 Sep. 8, 2011

Related U.S. Application Data

(62) Division of application No. 12/480,053, filed on Jun. 8, 2009, now Pat. No. 7,963,866, which is a division of application No. 11/307,790, filed on Feb. 22, 2006, now Pat. No. 7,563,184.

(60) Provisional application No. 60/655,967, filed on Feb. 23, 2005, provisional application No. 60/655,121, filed on Feb. 22, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | |
|---|---|---|---|
| 346,751 | A | 8/1886 | Hillman |
| 364,596 | A | 6/1887 | Luce |
| 891,813 | A | 6/1908 | Ceel |
| 1,459,389 | A | 6/1923 | Brown |
| 1,877,820 | A | 9/1932 | Costello |
| 2,039,138 | A | 4/1936 | Auer |
| 2,142,527 | A | 1/1939 | Pool |
| 2,508,519 | A | 5/1950 | Jay |
| 2,596,894 | A | 5/1952 | Frisch |
| 3,086,777 | A | 4/1963 | Lacoste |
| 3,306,960 | A | 2/1967 | Weissman et al. |
| 3,473,806 | A | 10/1969 | Patterson |
| 3,507,495 | A | 4/1970 | Tucker et al. |
| 3,591,178 | A | 7/1971 | Milligan et al. |
| 3,644,168 | A | 2/1972 | Bonk et al. |
| 3,702,702 | A | 11/1972 | Hoult |
| 3,788,941 | A | 1/1974 | Kupits |
| 3,822,062 | A | 7/1974 | Tucker et al. |

(Continued)

OTHER PUBLICATIONS

STX 2004 Lacrosse Catalog.

*Primary Examiner* — Gene Kim
*Assistant Examiner* — M Chambers
(74) *Attorney, Agent, or Firm* — Warner Norcross & Judd LLP

(57) ABSTRACT

A lacrosse head includes a base, a scoop, and a pair of sidewalls. The sidewalls include upper and lower rims and further include a dual flare configuration. The first flare is in a rear portion and is characterized by the upper rims of the sidewalls being spaced closer together to one another than the lower rims. The second flare begins from approximately the middle portion of the sidewalls and generally throughout the forward portion and is characterized by the upper rims of the sidewalls being spaced further apart from each other than the lower rims.

11 Claims, 3 Drawing Sheets

U.S. PATENT DOCUMENTS

| | | | | |
|---|---|---|---|---|
| D236,737 | S | 9/1975 | Brine | |
| 3,905,088 | A | 9/1975 | Tucker et al. | |
| 3,910,578 | A | 10/1975 | Brine, Jr. | |
| 3,934,876 | A | 1/1976 | Haddad | |
| 4,022,477 | A | 5/1977 | Pool | |
| 4,034,984 | A | 7/1977 | Crawford et al. | |
| 4,037,841 | A | 7/1977 | Lewis, Jr. | |
| 4,049,273 | A | 9/1977 | Pool | |
| D297,963 | S | 10/1988 | Tucker et al. | |
| D331,086 | S | 11/1992 | Brine, III et al. | |
| 5,568,925 | A | 10/1996 | Morrow et al. | |
| D376,183 | S | 12/1996 | Morrow et al. | |
| 6,066,056 | A | 5/2000 | Morrow | |
| 6,561,932 | B2 | 5/2003 | Morrow et al. | |
| D496,083 | S | 9/2004 | Kohler | |
| 6,902,501 | B2 | 6/2005 | Morrow et al. | |
| 6,916,259 | B2 | 7/2005 | Kohler et al. | |
| 7,563,184 | B2 | 7/2009 | Morrow et al. | |
| 7,963,866 | B2 * | 6/2011 | Morrow et al. | ..... 473/512 |
| 2005/0215360 | A1 | 9/2005 | Gait | |
| 2007/0060423 | A1 | 3/2007 | Morrow et al. | |

* cited by examiner

LACROSSE HEAD

TECHNICAL FIELD

The present invention relates generally to lacrosse heads, and more particularly to lacrosse heads having flared features for optimal playability.

BACKGROUND OF THE INVENTION

Lacrosse heads for use in the game of lacrosse are well-known and take on a variety of configurations. Current lacrosse heads are typically manufactured by injection molding processes and are secured to a metal lacrosse handle for use in play. The structure of lacrosse heads is commonly defined by a base portion disposed adjacent to a connection with the handle, a pair of opposing sidewall portions extending from the base portion, and a scoop portion connecting the ends of the pair of opposing sidewall portions opposite the base portion.

Lacrosse heads have securing mechanisms that are intended to receive a netting thereon that connects to the base portion, the pair of opposing sidewall portions, and the scoop portion. The netting is intended to retain a lacrosse ball therein. The scoop portions on current lacrosse heads have a generally smooth and planar inner surface. The smooth planar inner surface is intended to facilitate scooping of ground balls.

Traditional lacrosse heads had sidewalls where the upper rims and the lower rims lied in the same vertical plane with respect to a centerline of an attached handle. These vertically oriented sidewalls are perpendicular to a plane defined by an upper surface of the handle. As is known, ball retention is a desirable feature for most players and therefore, attempts have been made in this regard to provide structure for a lacrosse head that helps maintain a lacrosse ball in the pocket and helps to resist it from being knocked or dislodged from the lacrosse head. These structures, however have other disadvantages.

For example, some prior lacrosse heads have included ball retention features, such as a plurality of ball retaining ridges protruding from the interior surface of the sidewalls. Each ridge has an underside extending generally downwardly and outwardly toward the ball pocket and serves to direct and retain the ball within the pocket. While these ridges assisted in ball retention because they extend from the sidewalls into the pocket, they decreased the effective catching area of the lacrosse head.

Additionally, other prior lacrosse heads have been introduced having a base portion that is recessed or rounded in a direction opposite the open frame to assist in retaining a lacrosse ball therein. Other commercial lacrosse heads have pinched in the upper portions of the sidewall along their length such that the sidewalls angle outwardly therefrom and the upper rims are closer together than the lower rims. In other words, the upper rims lie closer together than the lower rims along their length. This configuration does provide some ball retention attributes, it also decreases the catching area of the head.

More recently, lacrosse heads were developed that provided increased ball retention capabilities without decreasing the catching area of the head. These lacrosse heads included sidewalls that were outwardly flared such that the lower rims of the sidewalls were closer together than the upper rims of the sidewalls along at least some of their length. These lacrosse heads also included lower rims that were oriented generally parallel to one another throughout the rear portion of the head to provide increased ball retention. While the sidewalls were closer together in the rear portion, these efforts to decrease the width therebetween has also increased the possibility of users stringing their heads such that the ball will be lodged in the head due to the decreased width in the rear portion. Such a configuration where the ball lodges in the head is illegal under many rules.

Thus, it would be desirable to provide a lacrosse head that provides the benefits of an increased catching area and increased ball retention characteristics without illegally trapping the ball in the head.

SUMMARY OF THE INVENTION

It is therefore an advantage of the present invention to provide a lacrosse head that is configured with a ball retaining area having an increased area for holding the ball within the head.

It is a related advantage of the present invention to provide a lacrosse head configured with a narrow pocket to keep the ball in line with the centerline of the stick.

It is a related advantage of the present to provide a lacrosse head that assists in preventing the lacrosse ball from being dislodged from the head during use.

It is still a further advantage of the present invention to provide a lacrosse head with a throat configuration that is stronger and lighter than prior lacrosse heads.

It is still another advantage of the present invention to provide a lacrosse head that assists in preventing the lacrosse ball from being dislodged from the head during use.

In accordance with the above and the other advantages of the present invention, an improved lacrosse head is provided. The lacrosse head includes a base, a scoop, and a pair of opposing sidewalls extending between and connecting the base and the scoop. Each of the sidewalls includes upper rims and lower rims having multiple flare configurations along their length. A first or rear flare is located in a rear portion of the sidewalls, which is the area generally nearer the base. In accordance with this rear flare, the sidewall upper rims are closer together than the sidewall lower rims such that the sidewalls are inwardly inclined with respect to a centerline of an attached handle from the lower rims to the upper rims. A second or forward flare is located in a forward portion of the sidewalls, which is an area beginning generally approximately at the middle portion of the sidewalls and extending generally to the scoop. In accordance with this forward flare, the sidewall lower rims are closer together than the sidewall upper rims such that the sidewalls are outwardly inclined with respect to a centerline of an attached handle from the lower rims to the upper rims.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION

Figure 2:
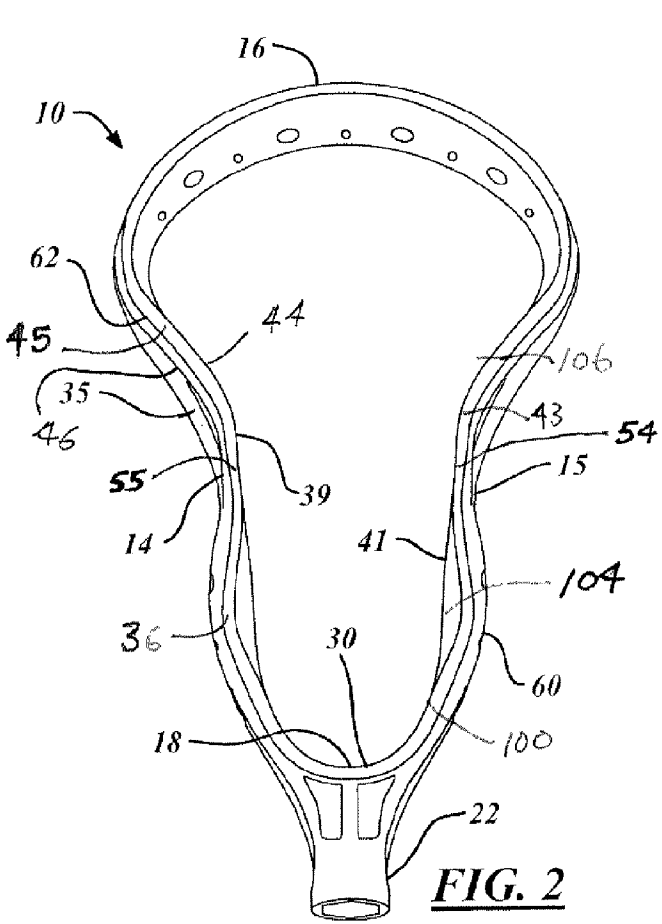
FIG. 2 is a rear view of the lacrosse head shown in FIG. 1.

In the following figures, the same reference numerals are used to identify the same components in the various views.

Referring to FIGS. 1 through 5, there are generally shown views of a lacrosse head 10 in accordance with one embodiment of the present invention. The lacrosse head 10 includes a pair of opposing sidewall portions 14, 15 or (left sidewall and right sidewall, respectively), a scoop portion 16 extending between and connecting the top ends of the sidewall portions 14, 15 and a base portion 18 extending between and connecting the bottom ends of the sidewall portions 14, 15. The lacrosse head 10 has a throat, socket or projection 22 that extends from the base portion 18 for attachment of a lacrosse stick handle therein. The attached handle defines a head/handle axis 58 along the centerline of the handle.

The pair of opposing sidewall portions 14, 15, the scoop portion 16, and the base portion 18 together form an open frame. In one embodiment, the frame is constructed of a plastic material and is preferably formed by injection molding processes. Of course, it will be understood by one of ordinary skill that the disclosed lacrosse head 10 may be constructed in various other suitable ways from other materials and by other manufacturing processes. Coupled to the open frame are a plurality of net attachment structures 19 or string-retaining means, which allow a net to be secured to the head 10. In one embodiment, the plurality of net attachment structures consist of string holes or openings formed in the frame. However, a variety of other suitable structures for allowing attachment of a net may also be utilized as will be appreciated by one of ordinary skill in the art.

As shown, each sidewall 14, 15 and the area between each sidewall is broadly divisible into a rear portion (R) adjacent the base 18 and a forward portion (F) adjacent the scoop portion 16. The division of the sidewalls 14, 15 into these broad areas preferably occurs generally at the mid-point of the sidewalls. It will be understood that the division of the sidewalls 14, 15 preferably can occur at a variety of other locations. The rear portion (R) of the head is generally the area where the upper rims 34 are spaced closer together to one another than the lower rims 36, such that the upper rims 34 can overlie a portion of a lacrosse ball and assist in retaining it in the head. The forward portion (F) of the head is generally the area where the upper rims 34 are spaced further apart from one another than the lower rims 36 to facilitate entry of a lacrosse ball into the head.

Figure 1:
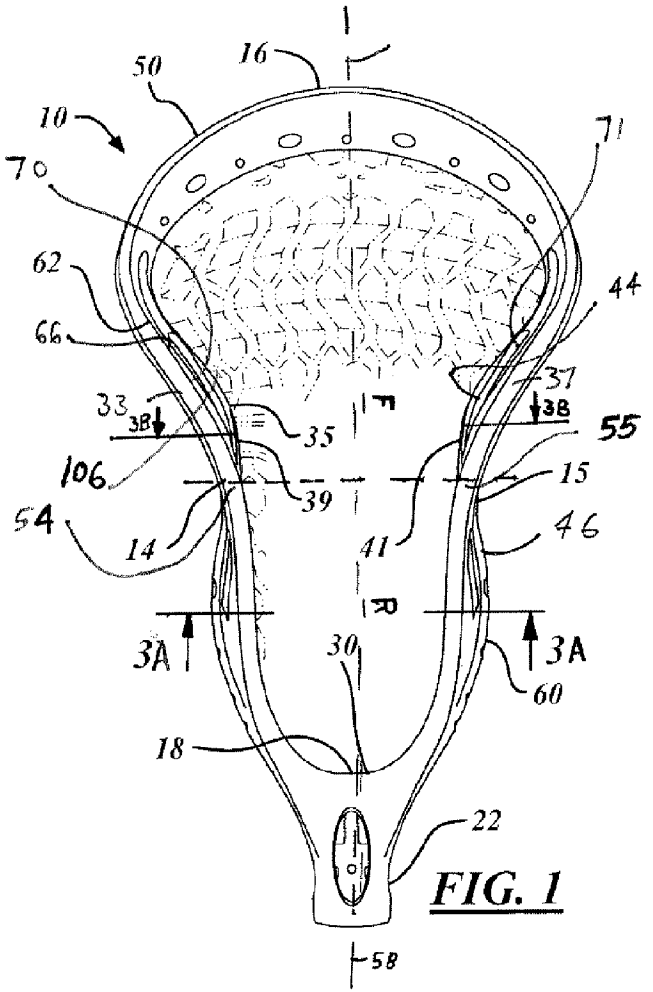
FIG. 1 is a front view of a lacrosse head according to a one embodiment of the present invention.
Figure 4:
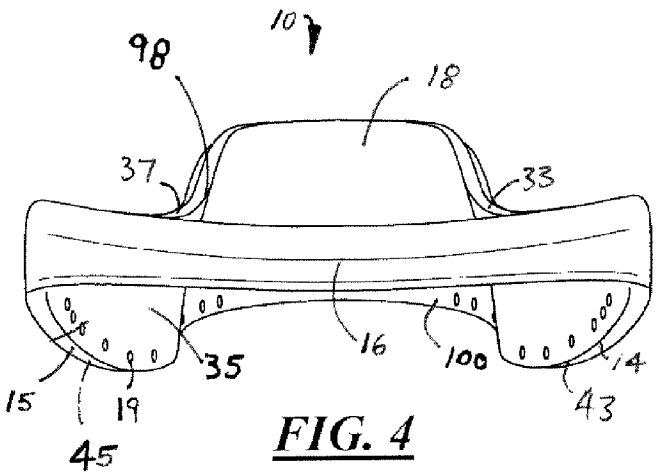
FIG. 4 is top view of the lacrosse head shown in FIG. 1.
Figure 3A:
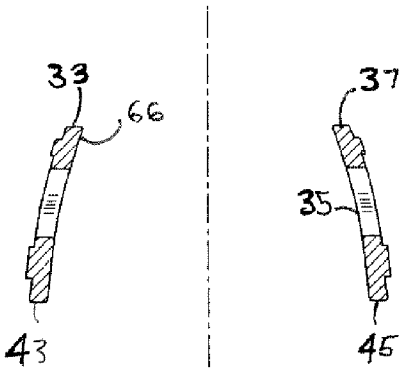
FIG. 3A is a cross-sectional view of the lacrosse head shown in FIG. 1, as taken in the direction of the arrows 3A-3A.
Figure 5:
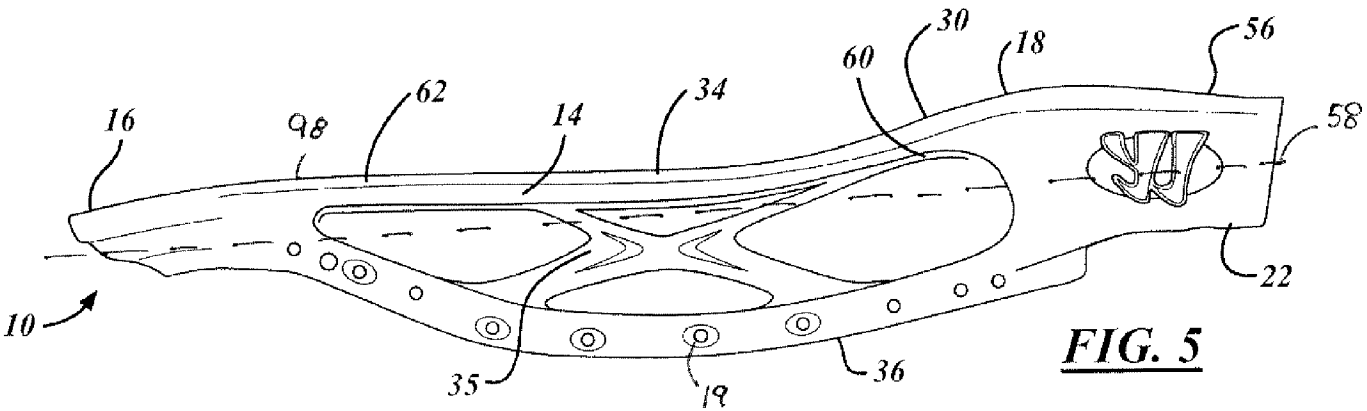
FIG. 5 is side view of the lacrosse head shown in FIG. 1.
Figure 3B:
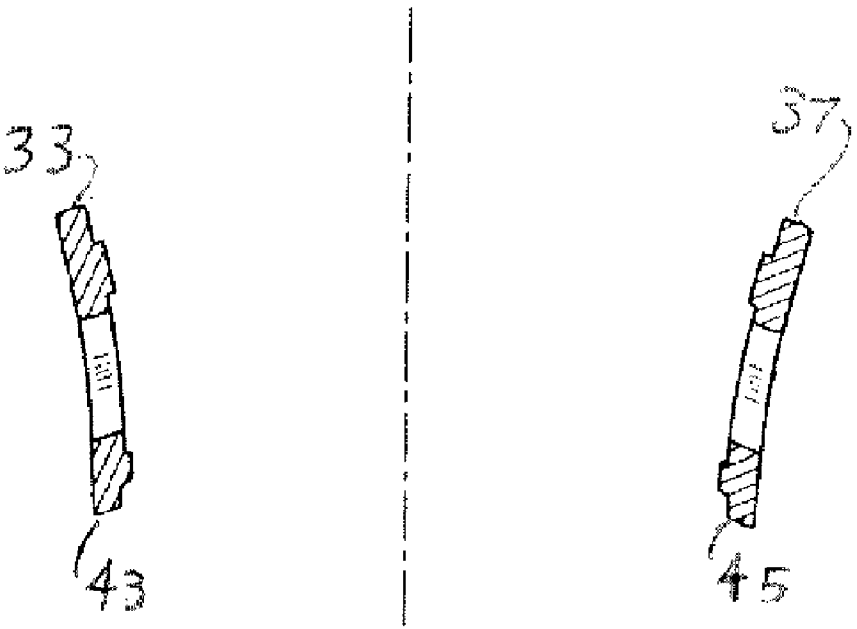
FIG. 3B is a cross-sectional view of the lacrosse head shown in FIG. 1, as taken looking in the direction of the arrows 3B-3B.

Referring primarily to FIGS. 1-2 and 5, which illustrate the relationship of the sidewalls 14, 15, to the socket or projection 22. Each sidewall 14, 15 includes an upper rim 34 (left upper rim 33 and right upper rim 37), a lower rim 36 (left lower rim 43 and right lower rim 45), and a sidewall surface portion 35.

The upper rims 34 of each of the sidewalls 14, 15 are preferably lowered with respect to a plane defined by an upper surface 56 of the socket 22 or an upper surface of an attached handle. In one embodiment, the upper rims 34 are lowed to a distance that are above the centerline or axis 58 of the lacrosse handle. Alternatively, the upper rims 34 could be lowered to a distance at or beneath the centerline or axis 58 of the handle. The upper rims 34 of the sidewalls 14, 15 are also preferably lowered downwardly in a gradually curving fashion. As is known, the upper rims 34 of the sidewalls 14, 15 may be lowered in other manners, such as by a sharp drop-off by a step or gradual slanting or other suitable ways as will be understood by one of ordinary skill in the art.

In one embodiment, the upper rims 34 once lowered to a specified distance remain lowered. In another preferred embodiment, the upper rims 34 of each sidewall 14, 15 can curve back or otherwise extend upward toward the plane defined by the upper surface 56 of the socket 22 or the upper surface of the attached handle as will be understood by one of ordinary skill in the art. In one embodiment, the upper rims 34 generally diverge continuously outwardly from the base 18 to the scoop 16 and include generally smooth inner sides 66. However, it will be understood that the sidewalls 14, 15 may only diverge over a portion of their length, such as the half adjacent scoop 16. In accordance with alternate embodiments, the upper rims 34 include a sinusoidal configuration or dual flare and/or the inner surfaces thereof have projecting portions.

In one embodiment, the lower rims 36 are generally sinusoidal relative to the upper rims 34 for a length thereof such that the lower rims 36 curve outwardly (away from the centerline 58) beyond a circumference of the upper rims 34 and then back inwardly (toward the centerline 58) in the rear portion (R). Thus, the lower rims 36 of each sidewall 14, 15 have an arcuate or bulbous section formed in the rear portion (R) to assist in retaining an lacrosse ball. As shown, the lower rims 36 extend outwardly further than the upper rims 34 beginning near the connection of the sidewalls 14, 15 to the base 18. By this configuration, the lower rims 36 are disposed further outwardly from the centerline 58 than the upper rims 34. Thereafter, the lower rims 36 extend inwardly back toward the centerline 58 such that near the middle portion 54, 55 of the sidewalls 14, 15 the upper rims 34 and the lower rims 36 lie at about the same distance from the centerline 58. Therefore, in at least a majority of the rear portion (R), the sidewall upper rims 34 are closer together than the sidewall lower rims 36. In other words, the sidewalls 14, 15 are inwardly (toward the centerline 58) flared from the lower rims 36 to the upper rims 34. Instead of the upper rims 34 being inwardly flared with respect to the lower rims 36, an upper section of the sidewalls 14, 15 could alternatively be disposed inwardly (flared) with respect to an upper section of the sidewalls 14, 15.

In this embodiment, in at least a majority of the forward portion (F), the sidewalls 14, 15 are outwardly (away from the centerline 58) flared from the lower rims 36 to the upper rims 34. Thus, beginning generally at the midsections 54, 55 of each of the sidewalls 14, 15, the lower rims 36 are disposed closer together than the upper rims 34. Indeed, in one embodiment, the distance difference between the lower rims 36 and the upper rims 34 continuously increases throughout the forward portion (F). Instead of the inward flaring being determined with respect to the upper rims 34 and the lower rims 36, the flaring may be characterized by the distances between an upper section and a lower section of each of the sidewalls 14, 15.

In other words, as shown, each sidewall 14, 15 is configured such that it extends generally inwardly or flares from the lower rims 36 to the upper rims 34 in the rear portion (R) (first area defining a first flared region) of the sidewalls 14, 15. Each sidewall 14, 15 is further configured such that it extends generally outwardly or flares from the lower rims 36 to the upper rims 34 in the forward portion (F) (second area defining a second flared region) of the sidewalls 14, 15.

In the rear portion (R), the upper portion of the sidewalls 14, 15 which include inner areas near the upper rims 34 or merely the upper rims 34 extend forwardly from the base 18 such that the upper rims 34 are spaced a relatively smaller distance apart. In one embodiment, the upper rims 34 are generally parallel to one another in the rear portion (R). In another embodiment, the upper rims 34 have a substantially uniform width therebetween. Alternatively, the upper rims 34 may extend from the base 18 in a diverging or slightly diverging manner. Functionally, the rear portion (R) is the area of the head 10 where the ball is typically retained in the head during play.

In the forward portion (F), the upper portions of the sidewalls 14, 15, which include either areas near the upper rims 34 or merely the upper rims 34, are flared outwardly from the centerline 58 relative to the bottom portions, which may include either areas near the lower rims 36 or merely the lower rims 36. This allows a lacrosse ball to be easily caught in the upper region. Functionally, the forward portion (F) is the area of the head 10 where the ball is typically caught and thrown from during play.

The rear portion (R) is defined by the base 18 and the sidewalls 14, 15. In the rear portion (R), the lower rims 36 of the sidewalls 14, 15 flare outwardly from the base 18 a substantial amount, forming a bulbous region (i.e. the lower portions extend outwardly and then extend back inwardly toward the centerline 58). In other words, the inward flaring from the lower rims 36 to the upper rims 34 is relatively large at the bulbous region. Contrary to some recent prior designs, the lower rims 36 are not generally parallel and do not extend continuously outward. Indeed, a portion of the lower rims 36 converge toward one another. The bulbous region promotes ball retention such that, once the ball has entered the head 10, within the upper rims 34 can overlie a lacrosse ball, such that it may be retained in the head 10 while the head rotates and moves during use. This substantial flaring between the lower rims 36 and the upper rims 34 in the rear section (R) promotes retention of the ball in the head during cradling of a lacrosse ball in the pocket of the head 10, as a greater area is provided in the rear portion (R) between the lower rims 36. Thereby, the lacrosse ball may move within the substantially increased pocket defined by the lower rims 36.

The disclosed lacrosse head 10 thus provides a dual flared design. The upper portion of the sidewalls 14, 15 are flared outwardly with respect to the lower portion in the forward portion (F), where the ball is typically caught or received and thrown from the head. This configuration results in an increased catching area or ball receiving area in the area where the ball typically enters and leaves the head. The lower portion of the sidewalls 14, 15 are flared outwardly in the rear portion (R) where the ball typically resides in the head. The configuration results in an increased ball retaining area in the area where the ball is typically retained in the head during play. The ball retaining area 100 includes a substantially convex area 104 from the base 18 towards the middle portions 54, 55 of the sidewalls 14, 15 and a substantially concave area 106 from the middle portion 54, 55 of the sidewalls 14, 15 to the scoop 16. It will be understood that while a dual flaring of the sidewalls 14, 15 is incorporated into the head in one embodiment, the sidewalls 14, 15 may have more than two flaring sections to provide different playing features for a user as will be understood by one of ordinary skill in the art.

The transition of the inward flaring to the outward flaring can occur at a variety of different locations on the head 10, but in one embodiment, this occurs at about the midsection or middle portions 54, 55 of the sidewalls 14, 15. Further, at the transition point, the sidewalls 14, 15 may have no flare at all (i.e. the upper rims 34 and the lower rims 36 are spaced the same distance apart from the centerline 58). It will be appreciated that the dual flaring concept can take on a variety of different configurations.

Referring again to FIGS. 1-5, the dual flared design thus provides a lacrosse head 10 with both increased catching capabilities and increased ball retention capabilities in the areas of the head where such capabilities are most desirable. The degree to which each sidewall 14, 15 is inclined or flares may be entirely uniform from the base 18 to the scoop 16, may progressively increase, may progressively decrease or take on a variety of other configurations.

Each sidewall 14, 15 includes an inner surface 44, configured to extend or flare in a generally continuous fashion from the upper rims 34 to the lower rims 36 or the lower rims 36 to the upper rims 34 depending upon the location of the head where the flaring occurs, and a corresponding outer surface 46. This configuration is generally curved, arcuate, or helical. However, it will be understood that the inner surface of each sidewall 14, 15 may alternatively be inclined, convex, stepped, or any combination of the above. Moreover, different portions of a single sidewall can take on a variety of different shapes and flares.

The catching area of the lacrosse head 10 is generally the area defined by the upper rims 34 of the sidewalls 14, 15, the upper rim 30 of the base 18, and the upper rim 50 of the scoop 16. The catching area is functionally the portion of the head 10 where the lacrosse ball is typically received into or exits from can be received and the head 10.

The pocket area of the lacrosse head 10 is generally the area defined by the lower rims 36 of the sidewalls 14, 15, the lower rim 32 of the base 18, and the scoop 16. The pocket area is functionally the portion of the head 10 where the ball is typically maintained in the head 16 and contacts the nettings. However, as set forth above, a player typically carries the lacrosse ball during possession thereof in the rear portion (R).

In accordance with one embodiment, the catching area is larger than the pocket area. It should be understood that the ball can be carried anywhere in the head, but is best retained in the rear portion 60 where the distance between the lower rims 36 of the sidewalls 14, 15 is widened.

While particular embodiments of the invention have been shown and described, numerous variations and alternate embodiments will occur to those skilled in the art.

What is claimed is:

1. A lacrosse head comprising:

a base;

a scoop;

a pair of opposing sidewalls extending between said base and said scoop, each of said sidewalls being divisible into a forward portion and a rear portion;

a throat portion extending rearwardly from said base for engagement with a lacrosse handle;

an axis defined by a centerline of said throat portion extending generally between said scoop and said base, said axis not intersecting either of said opposing sidewalls;

said sidewalls including an upper rim and a lower rim, said sidewalls flaring outwardly from said lower rims to said upper rims in said forward portion such that said lower rim is closer to said axis than said upper rim in said forward portion, said sidewalls flaring inwardly from said lower rim to said upper rim in said rear portion of said sidewalls such that said upper rim is closer to said axis than said lower rim in said rear portion;

wherein said lower rim of said sidewalls in said rear portion has a bulbous section to assist in retaining a lacrosse ball in the head, said bulbous section formed by a first section of said lower rim of said sidewalls in said rear portion extending away from said axis and a second section of said lower rim of said sidewalls in said rear portion extending toward said axis.

2. The lacrosse head of claim 1, wherein said upper rim of the head defines a ball receiving area and said lower rims of said head defines a ball retaining area.

3. The lacrosse head of claim 2, wherein said ball receiving area is progressively larger from said base towards said scoop.

4. The lacrosse head of claim 2, wherein said ball retaining area comprises a substantially convex area from said base towards a middle portion in the rear portion and a substantially concave area from said middle portion of said ball retaining area to said scoop in the forward portion.

5. The lacrosse head of claim 2, wherein said ball retaining area comprises string-retaining means and defines a ball possession area.

6. The lacrosse head of claim 1, wherein said sidewalls are flared outwardly from said lower rims to said upper rims throughout said forward section.

7. The lacrosse head of claim 6, wherein said sidewalls are flared inwardly from said lower rims to said upper rims throughout said rear section.

8. The lacrosse head of claim 7, wherein said division between said forward portion and said rear portion occurs generally at a midpoint of the said sidewalls.

9. The lacrosse head of claim 1, wherein said sidewall flaring in said forward portion progressively increases.

10. The lacrosse head of claim 1, wherein each of said sidewalls includes an inner surface that is generally smooth.

11. The lacrosse head of claim 1, wherein lower rims have a larger outward radius of curvature than said upper rims in said forward portion.

* * * * *